United States Patent [19]

Eggert

[11] 4,065,900

[45] Jan. 3, 1978

[54] PROFILE STRIP FOR FRAMING AND FASTENING SECONDARY GLAZING PANES

[75] Inventor: Frank Eggert, Hamburg, Germany

[73] Assignee: Schlegel GmbH, Hamburg, Germany

[21] Appl. No.: 639,798

[22] Filed: Dec. 11, 1975

[30] Foreign Application Priority Data

Dec. 13, 1974 Germany ..... 2459017

[51] Int. Cl.[2] ..... E04B 5/52; E04C 2/00

[52] U.S. Cl. ..... 52/476; 52/494; 52/627

[58] Field of Search ..... 52/202, 203, 287, 290, 52/476, 627, 628, 716, 494, 712

[56] References Cited

U.S. PATENT DOCUMENTS

| | | | |
|---|---|---|---|
| 2,492,566 | 12/1949 | Geyer | 52/582 |
| 2,496,910 | 2/1950 | Fridolph | 160/395 |
| 3,360,893 | 1/1968 | Wattelez | 52/476 |
| 3,868,789 | 3/1975 | Gates | 52/627 |
| 3,939,620 | 2/1976 | Bero | 52/476 |

FOREIGN PATENT DOCUMENTS

| | | | |
|---|---|---|---|
| 220,689 | 7/1942 | Switzerland | 52/202 |

*Primary Examiner*—Price C. Faw, Jr.
*Assistant Examiner*—Robert C. Farber
*Attorney, Agent, or Firm*—Cumpston & Shaw

[57] ABSTRACT

A profile strip for framing and fastening secondary glazing panes comprising a fastening flange for fastening the strip to a main frame, the flange having orifices for the passage of the heads of fastening screws, and extending from the fastening flange on one side a first profile part for framing the edge of a pane of glass and wherein along the opposite edge of the first profile part a second profile part is provided for clamping over the heads of said fastening screws which, in use, project outwardly above the fastening flange, the second profile part being hingedly connected to the first profile part along a hinge preferably formed of a softer material than the remainder of the profile strip.

11 Claims, 3 Drawing Figures

PROFILE STRIP FOR FRAMING AND FASTENING SECONDARY GLAZING PANES

Figure 1:
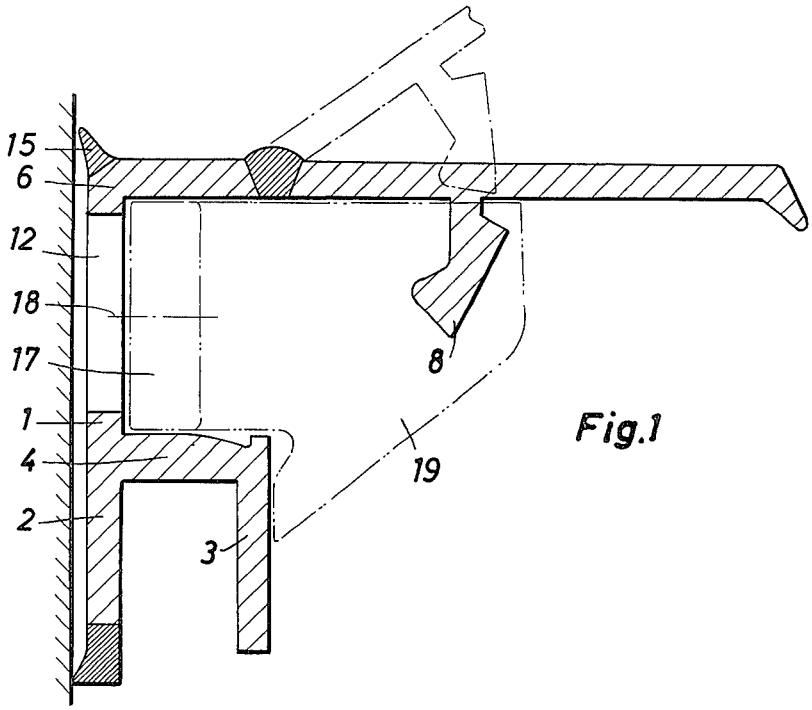

This invention relates to profile strip for framing and fastening secondary glazing panes.

In order to improve the accoustic and thermal insulation of windows, a secondary glazing pane can be used which is fastened to the window frame by means of a relatively weakly constructed auxiliary frame. The auxiliary frame may comprise two profile parts, the first of which frames the edge of the pane and has a fastening flange for fastening to the window frame, whilst the second profile part has the function of masking the fastening flange.

Such an auxiliary frame is required to be removable so that the space between the secondary pane and the normal pane is accessible for cleaning. To obviate the necessity of releasing all the fastening screws when it is desired to remove the auxiliary frame, a known auxiliary frame is made of plastics material so that a fastening flange on the first profile part exhibits such large orifices for the fastening screws that even the heads of the latter pass through. The second profile part is constructed as a resilient clamp which surrounds the heads of the screws and thereby secures the fastening flange of the first profile part. The secondary pane with the first profile part can be removed from the window without difficulty as soon as the second profile part has been released from the screw heads. It is very difficult to place the screws guiding the second profile part in perfect alignment. The screws generally vary more or less from the desired straight line, with the disadvantageous result that the second profile part also assumes a more or less ugly curved configuration. It has also been found to be practically impossible to cut the four profiles so that they butt together at the corners to form a uniform mitre with the desired precision and to make them butt neatly together. Lastly, the clamping fastening is also frequently found too irregular. If the screws are tightened too little, then the auxiliary frame does not sit firmly and air-tightly on the window frame, but if they are tightened too much, then the second profile part does not clamp securely enough.

The present invention is an improvement of this known profile strip for framing and fastening secondary glazing panes, and endeavours to avoid, or at least to reduce, the disadvantages referred to.

According to the present invention, a profile strip for framing and fastening secondary glazing panes comprises a first profile part for framing the edge of a pane extending from a fastening flange having orifices for the passage of the heads of fastening screws engageable in a main frame, and a second profile part which is clampable over the heads of the fastening screws, which, in use of the strip, project beyond the fastening flange, and wherein the second profile part is attached integrally and hingeably to the first profile part.

Due to the integral attachment, the second profile part cannot assume a curved shape differing from the first profile part. It is also stiffened by the first profile part so that it cannot immediately follow any irregularities in the pattern of the screws. At the corners, not four but only two profile strips butt together with a clearly defined position, with which a neat joint can be achieved considerably more easily, even with simple craftsman's means. The auxiliary frame according to the invention is therefore easier to fit and presents a more attractive appearance.

Advantageously, the hinge line of the hinged joint between the two profile parts is arranged to be located at the prescribed height of the screw heads or above it, i.e. spaced further from the main frame, and the second profile part has a catch part, located partly on the side of the heads remote from the main frame, co-operating with the screw heads. Alternatively, the hinge line of the hinged joint may be located nearer the main frame than the screw heads and the second profile part may have on the main frame side of the screw heads a catch part for co-operating with the screw heads. In each case, it is convenient if the second profile part in the closed position co-operates and engages with the first profile part in such a way that it is secured in that position independently of its co-operation with the screw heads. This applies more particularly when the second profile part masks the entire first profile part in lid-fashion, because then it is certain that the second profile part uniformly occupies the desired position everywhere irrespectively of the particular position of the screws.

If the catch part on the second profile part which co-operates with the screw heads is arranged outwardly of the screw heads, then it is advantageously constructed as a hook-like projection having at least a latching surface extending substantially in a circular arc about the hinge line. If its shape follows a circular arc precisely, then it can be hinged round the screw heads geometrically and without obstruction, and in its closed position lies partially beneath the screw heads, so that the latter are secured within the profile strip. In the majority of cases, however, the projection will also be provided with retaining projections departing from the circular arcuate shape, so that it can co-operate better with the screw heads. If a force is exerted on the auxiliary frame tending to lift it from the main window frame, which is synonymous with a force tending to extract the screw heads from the profile strip, then the screw heads have a tendency to displace the catch part by co-operating with them laterally. In order to prevent this, it may be advantageous if the catch part is braced on the side remote from the screw heads by that portion of the first profile part which frames the edge of the pane. This bracing will often be present solely due to the fact that the space between the portion of the first profile part framing the edge of the pane and the screw heads is dimensioned just so closely that the catch part fits in. The catch part, or the part of the profile part framing the edge of the pane, may however, also be equipped with additional devices for bracing.

It has been found convenient if the first profile part is provided with a resilient sealing lip on at least one edge of its main frame engaging surface. This sealing lip is intended to serve not only to prevent the penetration of dirt and moisture into the enclosed space, but also because of its elasticity, the auxiliary frame seats uniformly against the window frame in all parts even in the case of a slightly varying tightening of the screws.

In order to ensure a uniform aligned arrangement of the screws following the shape of the auxiliary frame, the fastening flange may advantageously be bounded on both sides of its outer face by guide surfaces for a drilling template. In this case it is further advantageous if the space between the top of the fastening flange and the catch part on the second profile part when hinged upwards, i.e. open, is shorter than the height of the drilling template. By this means, the second profile part is prevented from assuming an obstructing position over the fastening flange in the drilling region where the template is present.

Figure 2:
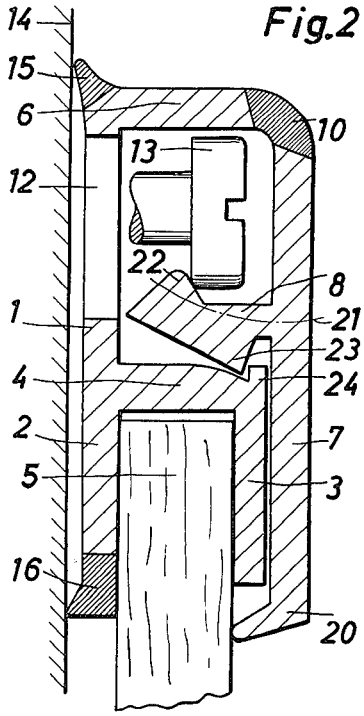
Figure 3:
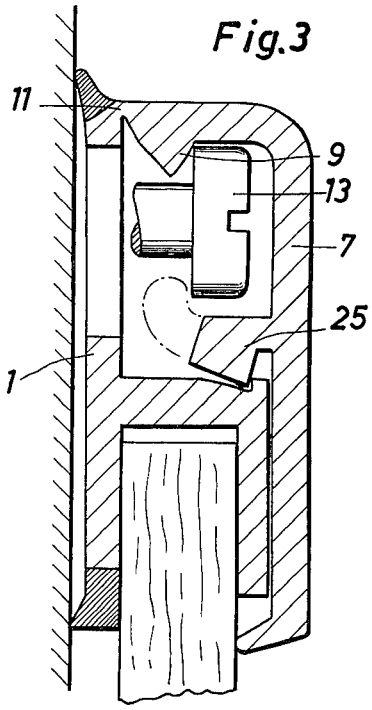

The invention is more fully explained hereinbelow with reference to the accompanying drawing, which illustrates, by way of example, in cross section two preferred embodiments substantially accurately to the scale of 5:1. In the drawing:

FIGS. 1 and 2 show a first embodiment in an open and closed state respectively, and FIG. 3 shows a second embodiment in a closed state.

In the examples illustrated, a first profile part comprises a fastening flange 1 and a U-shaped part composed of flanges 2, 3 and a web 4 to frame the edge of a secondary pane 5. In the example according to FIGS. 1 and 2, a side wall 6 adjoining the fastening flange 1 also forms part of the first profile part. The transition to a second profile part, which comprises a cover part 7 and a catch part 8 (or 9 in the construction of FIG. 3), is constituted by a hinged joint 10 (or 11 in FIG. 3) which in the embodiment according to FIGS. 1 and 2 is constituted as the transition from the side wall 6 to the cover part 7 by a region of softer material indicated by closer hatching, whereas in the case of the embodiment according to FIG. 3 it is constituted immediately adjacently to the fastening flange 1 by a region of small thickness which may likewise (though not indicated) consist of soft material in order to improve flexibility, but may also in most cases be moulded into the harder material predominently constituting the profile strip.

The fastening flange 1 is provided at specific intervals along its length with orifices 12 which are of such dimensions that the heads 13 of screws inserted into a window frame 14 pass through them. The fastening flange 1 is provided at its edge remote from the secondary pane with a soft elastic lip 15, whereas the edge distant therefrom of the flange 2 and prolonging the fastening flange terminates in a strip of softer material 16 which likewise bears a lip extending towards the window frame 14 and also resiliently contacts the secondary pane 5.

In the example according to FIGS. 1 and 2, the fastening flange 1 which is parallel to the secondary pane 5 merges at right angles into the side wall 6 at its edge remote from the secondary pane. Between this side wall 6 and the web 4 of the profile part framing the edge of the secondary pane, there is thus formed a channel which is suitable for guiding a template for the insertion of the screws, which is indicated by dash-dot-dot lines in FIG. 1. This template comprises a base part 17 which is provided with suitable holes (indicated by centre line 18) to guide a drill or the screws, and the height of which corresponds to the desired interval of the bottom surface of the screw heads from the face of the fastening flange 1, and a handle 19 which may be of asymmetrical construction if in the case of a non-central position of the screws it is required to ensure the correct insertion of the template into the channel. The handle 19 extends outwardly sufficiently far from the fastening flange that the catch part 8, when in its open position indicated by dash-dot lines in FIG. 1, is forced so far outwards in the region of the template that it cannot obstruct the drilling or the insertion of the screws.

The cover part 7 extends from the hinged joint 10 across the entire first profile part and is eventually engaged against the secondary pane by an angled part 20. A clear visual appearance is thus obtained without grooves, which might tend to harbour dirt.

The catch part 8 approximately follows in its configuration a circular arc 21 about the pivot line or point of hinged joint 10, the geometrical arrangement being such that a base portion 22 of catch part 8 engages under the screw head 13. This base portion 22 may be conformed differently from the circular arcuate shape in a suitable manner in order to improve the retaining effect. On the opposite side of the catch part, a lug 23 is provided which, in the closed state of the profile, co-operates and catches with a corresponding lug 24 on the web 4 in order to retain the second profile part in the closed position.

If the hinged joint 10 is located substantially in line with the screw head 13 or (as shown) slightly proud, the catch part 8, in the case of a configuration approximately following a circular arc, can be pivoted without substantial elastic deformation into the space existing between screw head 13 and web 4, and then automatically arrives in the region below the screw head, in order to secure the latter against relative movement within the profile strip in the axial direction of the screw. But of course, departures from this circular arcuate shape are possible and possibly even advantageous if the catch part — possibly with corresponding deformation of the catch part, of the lip 15 or side wall 6, or of the web 4 — can be pushed into the space between screw head 13 and web 4, and if such departures achieve a better engagement of the catch part of the screw head or better bracing of the catch part against the web 4.

In the embodiment according to FIG. 3, the pivot point or hinge line 11 is arranged or located nearer to fastening flange 1 than the screw heads 13 and the catch part 9 is placed close to the pivot point. The catch part is therefore pivoted into the space between fastening flange 1 and the rear surface of screw head 13 from the side of the pivot point during the closing movement of the second profile part. For the mutual engagement of the two profile parts in the closed position a projection 25 is provided, the shape of which, conforming to this function, may be restricted compared to the catch part 8 of FIGS. 1 and 2, but which may also (as indicated by chain dotted lines in FIG. 3) be extended so that it likewise co-operates with and retains the screw head 13. Because in this case the cross-section of the projection 25 cannot move in a circular arc about the pivot point 11, the projection is brought into the closed position with corresponding elastic deformation.

The use of the profile according to the invention is not restricted to the fitting of additional panes to windows; it is suitable for all cases where panes are required to be fitted to frame elements parallel to the plane of the pane, for example when glazing partition walls.

The profile strip according to the invention is used in the following way:

The profile strips constituting the auxiliary frame, conveniently after they have been applied to fit the secondary pane, are placed upon the supporting frame and are optionally fixed temporarily thereon by suitable means. With the aid of the template, screws of the prescribed head dimensions are inserted. It is then only necessary to close the second profile part, and the assembly is complete. If it is required to remove the secondary pane, then the second profile part is hinged open again and individual profile strips or the entire arrangement can be removed without having to release the screws.

What is claimed is:

1. A profile strip for framing glazing panes and fastening the panes to screw heads on a main support frame comprising:

a first profile part having (1) means for framing the edge of a pane, and (2) a flange defining orifices of one diameter; and a second profile part connected by a hinge to said first profile part, said second profile part having a cover part and a catch member and being pivotal about said hinge in a substantially circular arc between an open position in which each of said orifices are exposed for the passage therethrough of a supporting screw head of a diameter smaller than said one diameter when the profile strip is mounted thereon, and a closed position in which each of said orifices and the directly opposed surface of said cover part in alignment therewith define a space therebetween into which the screw head extends with its rear surface spaced a short distance away from said orifice and said catch member is moved without substantial deformation between the rear surface of the screw head and said orifice for releasably securing the profile strip to the main frame.

2. The profile strip according to claim 1 wherein said catch member extends substantially perpendicular to said cover part, said profile strip further comprising a first latch means on said framing means, and a second latch means on said catch member cooperating with said first latch means to releasably retain said second profile part in its closed position and for substantially preventing movement of said catch member in a direction to release the screw head.

3. The profile strip according to claim 2 wherein said framing means comprises a frame of substantially U-shaped cross section for receiving the edge of the pane, and said first latch means is on said frame for bracing said catch member.

4. A profile strip for framing and fastening secondary glazing panes to a main frame comprising:

a first profile part;

means on said first profile part for framing the edge of a secondary pane;

a fastening flange on said first profile part defining orifices for the passage of the heads of screws fastened to the main frame with the heads and said orifices defining a space therebetween when the profile strip is mounted on the screws with said fastening flange engaging the main frame;

a second profile part having a catch member; and hinge means for integrally and hingeably connecting said first profile part to said second profile part, said second profile part further being movable about said hinge means between an open position in which the profile strip can be mounted on the screws, and a closed position in which said catch member is moved into the space between the screw heads and said fastening flange for locking the profile strip to the mounting screws.

5. The profile strip according to claim 4 and further comprising a first latch means on said first profile part cooperating with a second latch means on said second profile part for releasably retaining said second profile part in its closed position.

6. The profile strip according to claim 5 wherein said first latch means is on said framing means for bracing said catch member, and said second latch means is on said catch member.

7. The profile strip according to claim 5 wherein said framing means comprises a frame of substantially U-shaped cross section for receiving the edge of the secondary pane, said first latch means is on said frame for bracing said catch member, and said second latch means is on said catch member.

8. A profile strip according to claim 4 in which said hinge means connecting said first profile part to said second profile part is located nearer said fastening flange than said screw heads and wherein said catch member is adjacent said hinge.

9. A profile strip according to claim 4 in which said catch member on said second profile part is constructed as a hook-like projection extending substantially in the direction of a circular arc around the pivot line of said hinge.

10. A profile strip according to claim 4 including a resilient sealing lip on said first profile part on at least one edge of its main frame engaging surface.

11. A profile strip according to claim 4 wherein said framing means and a portion of said fastening flange define guide surfaces for a drilling template.

* * * * *